US006668805B2

(12) United States Patent
Kato et al.

(10) Patent No.: US 6,668,805 B2
(45) Date of Patent: Dec. 30, 2003

(54) ACCUMULATOR FUEL INJECTION APPARATUS

(75) Inventors: Akira Kato, Nagoya (JP); Tatsumasa Sugiyama, Anjyo (JP)

(73) Assignee: Denso Corporation, Aichi-pref. (JP)

( * ) Notice: Subject to any disclaimer, the term of this patent is extended or adjusted under 35 U.S.C. 154(b) by 0 days.

(21) Appl. No.: 10/360,930

(22) Filed: Feb. 10, 2003

(65) Prior Publication Data

US 2003/0121502 A1 Jul. 3, 2003

Related U.S. Application Data

(63) Continuation of application No. PCT/JP02/05744, filed on Jun. 10, 2002.

(30) Foreign Application Priority Data

Jun. 14, 2001 (JP) ..... 2001-179731

(51) Int. Cl.[7] ..... F02M 51/00
(52) U.S. Cl. ..... 123/491; 123/456
(58) Field of Search ..... 123/456, 447, 123/491, 514, 495, 446; 417/53, 462

(56) References Cited

U.S. PATENT DOCUMENTS 4,884,545 A * 12/1989 Mathis ..... 123/447
6,293,757 B1 * 9/2001 Oda et al. ..... 417/53
6,311,674 B1 * 11/2001 Igashira et al. ..... 123/458

FOREIGN PATENT DOCUMENTS

| | | |
|---|---|---|
| EP | 0902181 | 3/1999 |
| JP | 7-103097 | 4/1995 |
| JP | 9-166061 | 6/1997 |
| JP | 11-315730 | 11/1999 |

* cited by examiner

*Primary Examiner*—Mahmoud Gimie
(74) *Attorney, Agent, or Firm*—Nixon & Vanderhye PC

(57) ABSTRACT

A pump control valve contained in a high-pressure fuel pump is closed when an engine is stopped, so that the pressure of a common rail is prevented from becoming too high when the engine speed NE is not less than a predetermined value α. The pump control valve is opened when the engine speed NE is decreased to a predetermined value α. Consequently, a predetermined amount of fuel is stored in the pump because the high-pressure fuel pump sucks fuel but does not deliver the fuel to the common rail. Therefore, a lack of fuel being delivered at early stage of startup is prevented because the fuel stored in the pump can be delivered to the common rail in a subsequent startup of the engine. Thus, the pressure of fuel necessary to start the engine can be obtained in a short time, and the time for startup can be decreased.

6 Claims, 4 Drawing Sheets

ACCUMULATOR FUEL INJECTION APPARATUS

CROSS-REFERENCE TO RELATED APPLICATIONS

This application is based upon and claims the priority of Japanese Patent Application No. 2001-179731, filed Jun. 14, 2001, the contents being incorporated therein by reference, and a continuation of PCT/JP02/05744 filed Jun 10, 2002.

FIELD OF THE INVENTION

The present invention relates to an accumulator fuel injection apparatus, in which high-pressure fuel generated in a high-pressure fuel pump is stored in a common rail and, then, is injected into a cylinder of an engine through an injector.

TECHNICAL BACKGROUND

Conventionally, a known accumulator fuel injection apparatus is provided with a high-pressure fuel pump to generate high-pressure fuel and deliver the same to a common rail. The high-pressure fuel pump is comprised of an electromagnetic valve to open/close an intake passage for fuel. When the electromagnetic valve is opened in an upward movement of a plunger housed in the pump, low-pressure fuel sucked in a plunger chamber is pressurized to generate high-pressure fuel and, then the high-pressure fuel is delivered to the common rail.

However, in the above high-pressure fuel pump, when an IG switch is turned off, the electromagnetic valve is fully closed to stop the sucking of fuel into the pump (plunger chamber). Accordingly, the pump is empty (there is no fuel) when the engine is stopped. Therefore, in a subsequent startup of the engine, the fuel is sucked into the pump and then the fuel is delivered (i.e., no fuel is delivered at early stage of the startup of the engine). Consequently, a pressure of fuel, necessary to start the engine, cannot be obtained because the delivery of fuel to the common rail is delayed. This causes a problem in which the time for startup is increased.

DISCLOSURE OF THE INVENTION

The present invention is provided in view of the above circumstances, and the object thereof is to provide an accumulator fuel injection apparatus in which fuel is stored in a high-pressure fuel pump when the engine is stopped, so that a subsequent startup can be enhanced.

According to a first aspect of the present invention, there is provided an accumulator fuel injection apparatus, comprising a high-pressure fuel pump driven by an internal combustion engine; a common rail for storing high-pressure fuel delivered from the high-pressure fuel pump; an electromagnetic valve to open/close an intake passage through which the high-pressure fuel pump sucks fuel; and control means in which a fuel intake mode to cause the high-pressure pump to suck the fuel is set and carried out during the time between receipt of operation stopping instructions by the internal combustion engine and an actual stopping of the operation (Engine speed=0).

According to the present invention, fuel can be stored in the high-pressure fuel pump because a fuel intake mode is carried out during the time between receipt of operation stopping instructions by the engine and an actual stopping of the operation. Consequently, the fuel stored in the pump when the engine is stopped is delivered to the common rail in a subsequent startup of the engine. Therefore, the pressure of fuel necessary to startup the engine can be obtained in a short time, and the time for startup can be decreased.

The present invention can be further and sufficiently understood by reference to the accompanying drawings and the preferred embodiments in the following.

BEST MODE FOR CARRYING OUT THE INVENTION

Embodiments of the present invention will be described below with reference to the drawings.

Figure 3:
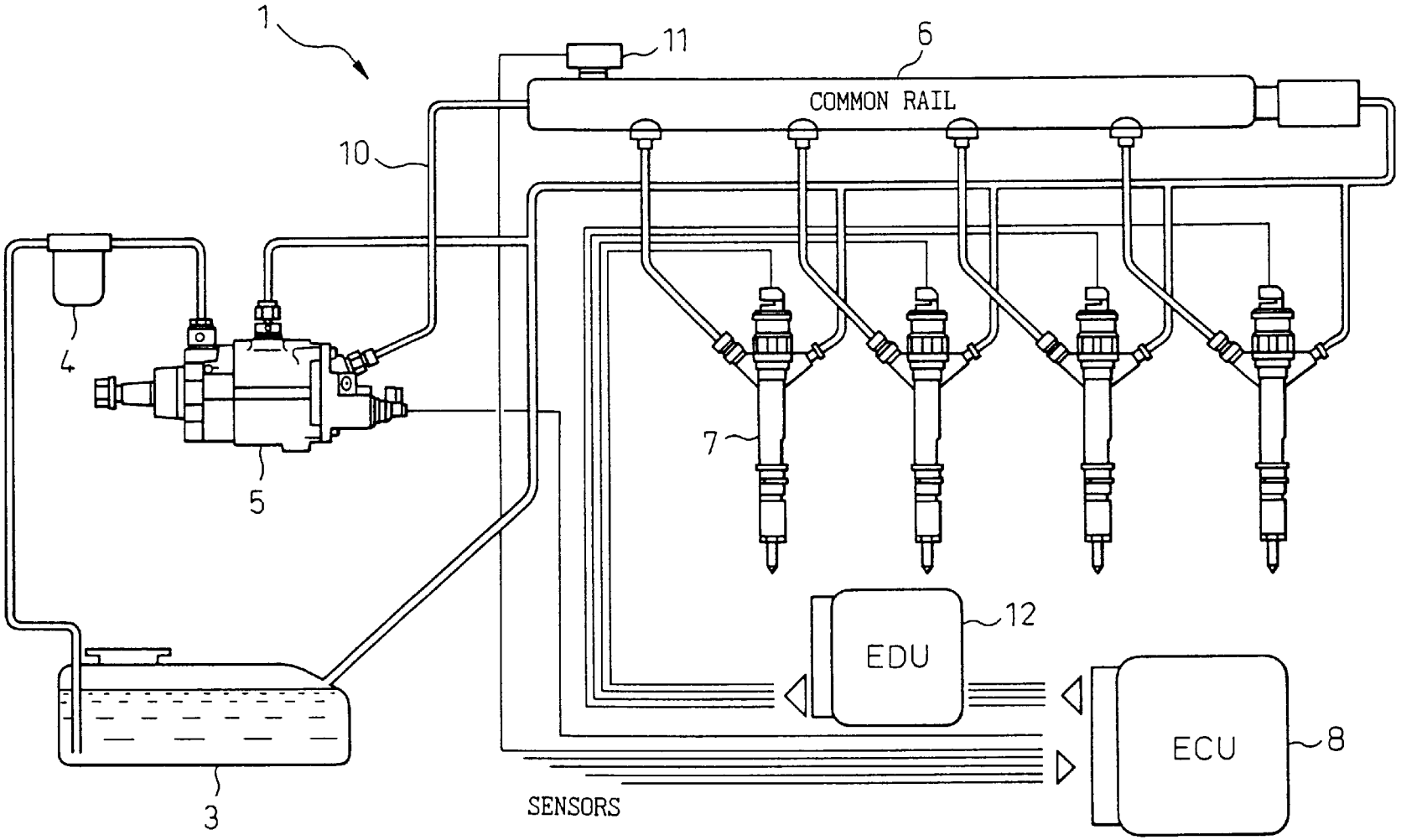
FIG. 3 is a view of a system of an accumulator fuel injection apparatus.

FIG. 3 is a view of a system of an accumulator injection apparatus.

An accumulator injection apparatus 1 according to the present embodiment is applied to, for example, a four-cylinder diesel engine (hereinafter called "engine"), and is provided with a high-pressure fuel pump 5 that sucks fuel pumped from a fuel tank 3 by a low-pressure pump 2 (see FIG. 4), via a fuel filter 4, and pressurizes the fuel to discharge, the same; a common rail 6 which stores high-pressure fuel delivered from the high-pressure fuel pump 5; an injector 7 which injects the high-pressure fuel supplied from the common rail 6 into a cylinder of an engine; and an electronic control unit (called "ECU 8") which controls operations of the present system based on information input from several kinds of sensors.

Figure 4:
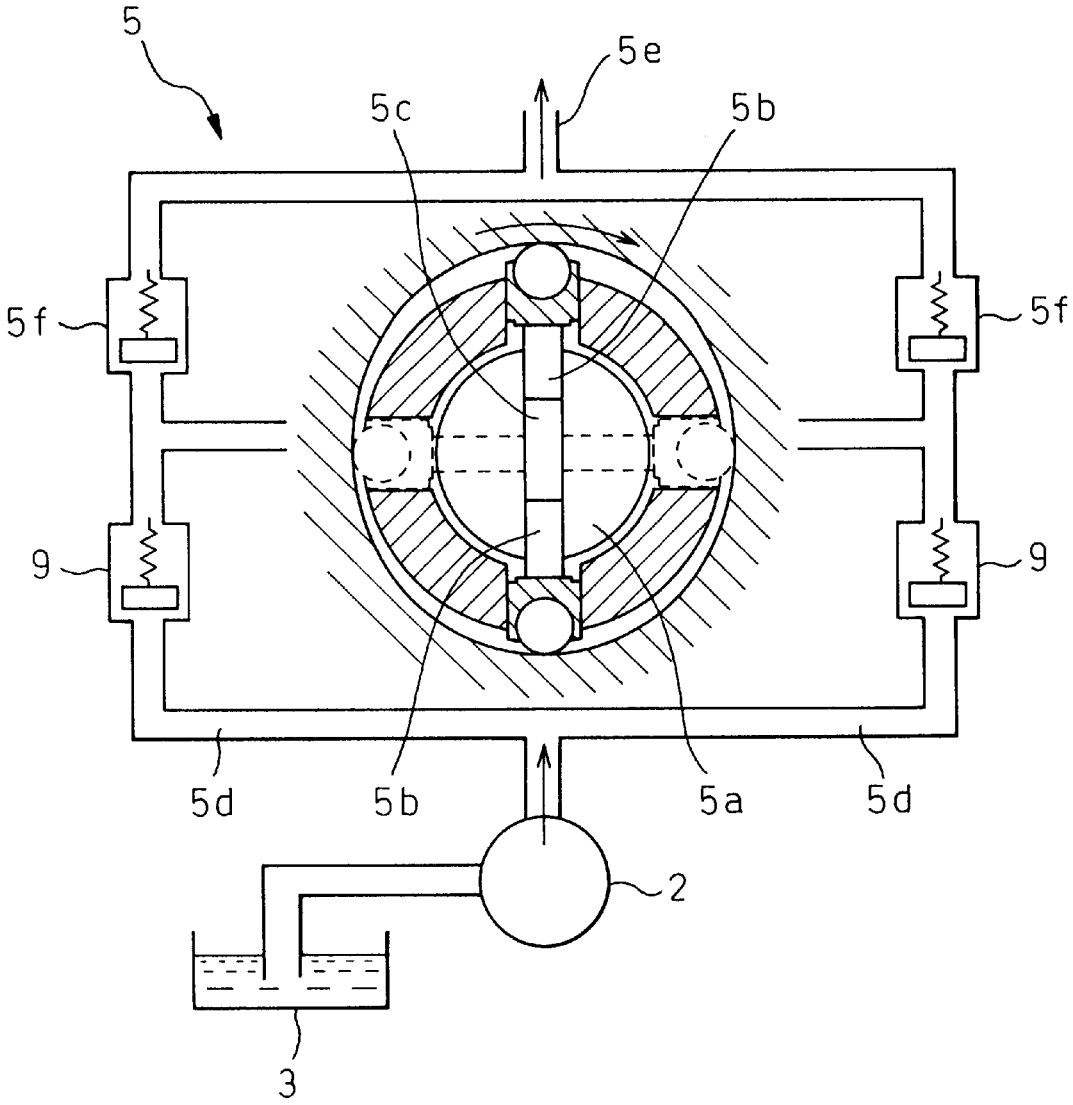
FIG. 4 is a schematic view of the structure of a high-pressure fuel pump.

As shown in FIG. 4, the high-pressure fuel pump 5 is comprised of a plunger 5*b* which reciprocates in a cylinder 5*a* in synchronization with a revolution of the engine, an intake passage 5*d* through which fuel pumped from the fuel tank 3 by the low-pressure pump 2 is introduced into a pump chamber 5*c* formed in the cylinder 5*a,* a pump control valve 9 (electromagnetic valve according to the present invention) which opens/closes the intake passage 5*d,* a discharge passage 5*e* which discharges the high-pressure fuel pressurized in the pump chamber 5*c,* and a check valve 5*f* provided in the discharge passage 5*e.*

The operation of the high-pressure fuel pump 5 will be described below.

The pump control valve 9 opens the intake passage 5*d* in a downward movement of the plunger 5*b,* so that the fuel pumped by the low-pressure pump 2 is sucked to the pump chamber 5*c* through the intake passage 5*d.* After that, the pump control valve 9 closes the intake passage 5*d* in an upward movement of the plunger 5*b,* so that the fuel sucked to the pump chamber 5*c* is pressurized. When the pressure of fuel overcomes a valve closing pressure of the check valve 5*f,* the high-pressure fuel opens the check valve 5*f* and, then is delivered to the common rail 6 through the discharge passage 5*e* and a high-pressure pipe 10 (see FIG. 3).

ECU 8 controls a discharging amount of fuel discharged from the high-pressure fuel pump 5 through the pump control valve 9, based on feedback of a real pressure in a pressure sensor 11 disposed in the common rail 6, so that a target pressure of the common rail required in accordance with an engine speed and a load of the engine can be obtained.

ECU 8 controls an energized electromagnetic valve (not shown) incorporated in the injector 7, via a driving unit (EDU) 12, to control the amount and timing of injection from the injector 7 depending on the timing and period for energizing the electromagnetic valve.

In the accumulator fuel injection apparatus according to the present invention, a fuel intake mode to suck fuel into the high-pressure fuel pump 5 is set when the engine is stopped, and is carried out by ECU 8.

Figure 1:
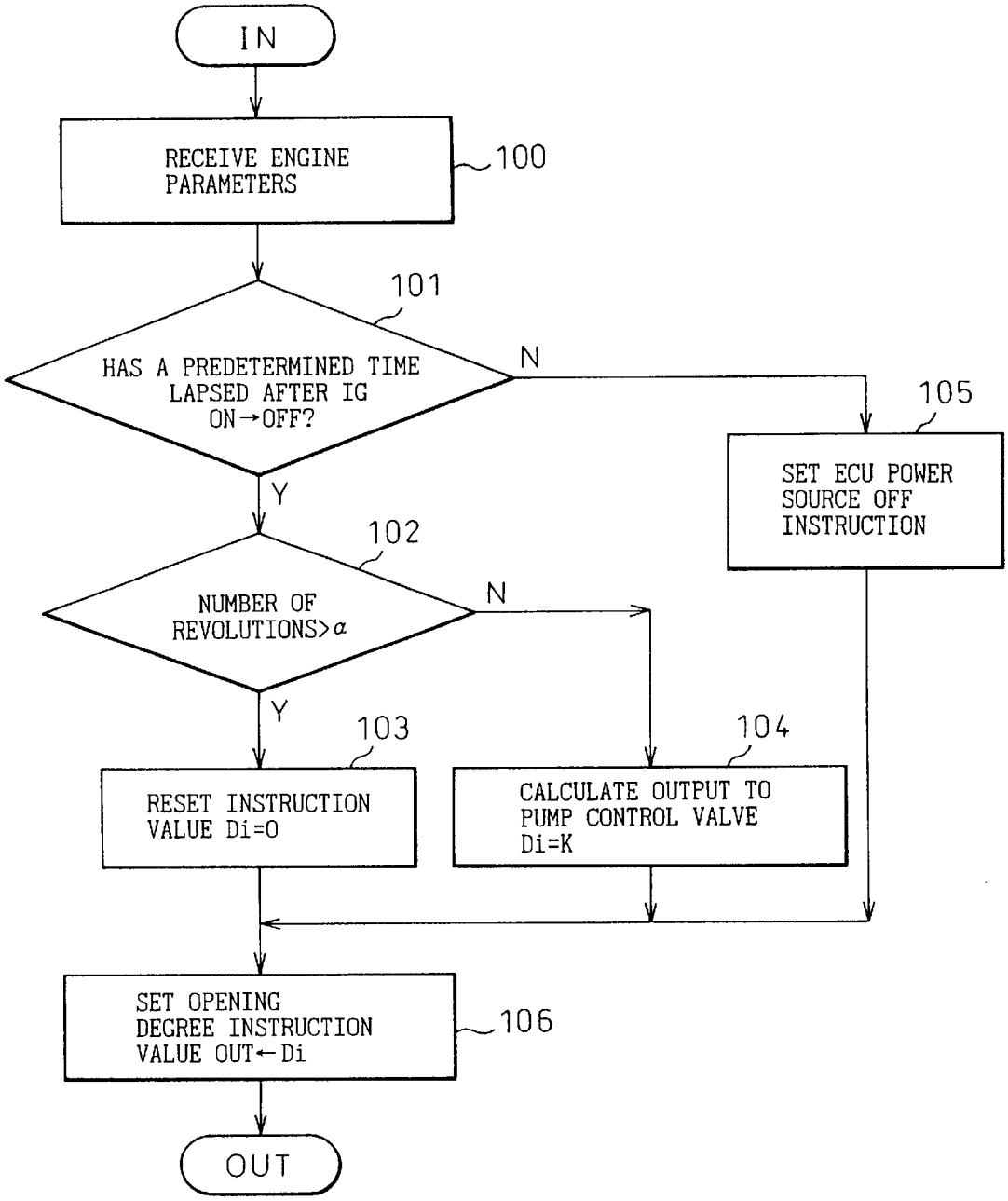
FIG. 1 is a flowchart of an operation procedure of an ECU.

The operation procedure of the ECU 8 to carry out the fuel intake mode will be described based on a flowchart shown in FIG. 1.

Step 100 . . . Parameters showing a state of controlling an engine (for example, the engine speed, the opening angle of an accelerator, etc.) are received.

Step 101 . . . Whether or not a predetermined time has lapsed after an IG switch turns on to off is judged. The routine goes to Step 102 if a result of the judgment is YES (i.e., within a predetermined time), and goes to Step 105 if a result of the judgment is NO (i.e., after a predetermined time).

Step 102 . . . Whether or not the engine speed NE is larger than a predetermined value $\alpha$ is judged. The predetermined value $\alpha$ is defined as the engine speed at which the high-pressure fuel pump 5 can suck fuel, but cannot deliver the fuel to the common rail 6. The routine goes to Step 103 if a result of the judgment is YES ($NE>\alpha$), and goes to Step 104 if a result of the judgment is NO ($NE\leqq\alpha$).

Step 103 . . . The instruction value of an opening angle output for the pump control-valve 9 is set as Di=0 (full close instruction) and, then the routine goes to Step 106.

Step 104 . . . The instruction value of an opening angle output for the pump control valve 9 is set as Di=K (predetermined opening angle) and, then the routine goes to Step 106.

Step 105 . . . The instruction value for turning off a voltage of a power source of the ECU 8 is set and, then the routine goes to Step 106.

Step 106 . . . The instruction value Di set in Step 103 or Step 104 or the OFF instruction value set in Step 105 is set in an output port of the ECU 8.

The operation of the present invention will be described using the timechart shown in FIG. 2.

If the engine speed NE is larger than the predetermined value a when the IG switch is turned off ("a" in FIG. 2), the pump control valve 9 is controlled to be fully closed to prevent the common rail pressure from becoming too high in preparation for a subsequent startup of the engine. Thus, the amount of fuel in the pump 5 is gradually decreased because the high-pressure pump 5 cannot suck fuel again, and the fuel is delivered to the common rail 6 until the engine speed NE is decreased to the predetermined number $\alpha$ ("a" to "b" in FIG. 2).

Figure 2:
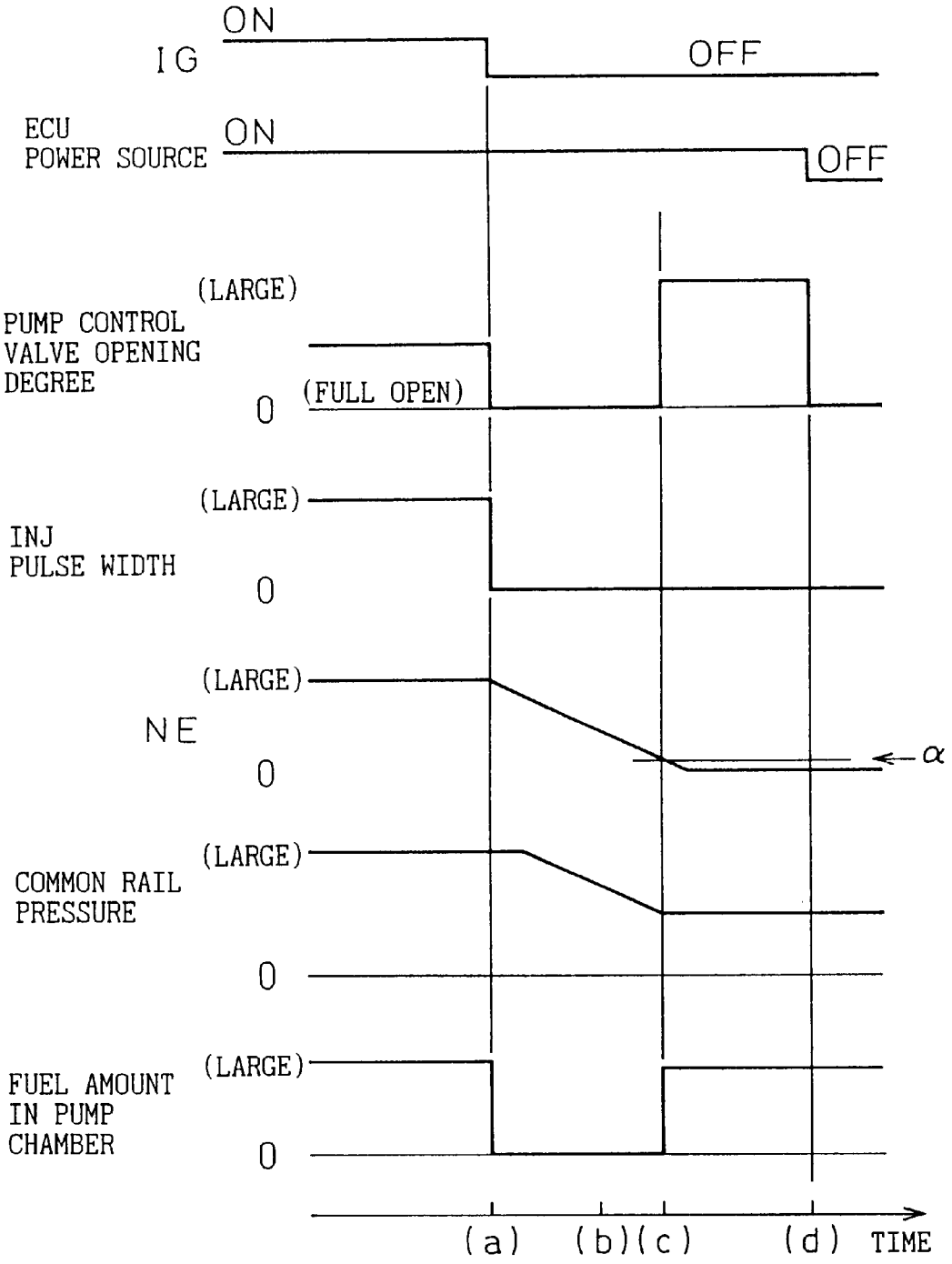
FIG. 2 is a timechart of a controlling operation in the present embodiment.

After that, the pump control valve 9 is opened to suck fuel to the high-pressure fuel pump 5 when the engine speed NE of the engine is decreased to the predetermined value $\alpha$ ("c" in FIG. 2). At this time, the opening angle of the pump control valve 9 is determined (for example, fully opened) to prevent the occurrence of insufficient sucking because the engine speed NE has already decreased.

The power source voltage of the ECU 8 is turned off to stop the fuel intake mode when a predetermined time is lapsed after the IG switch is turned off ("d" in FIG. 2).

In the accumulator fuel injection apparatus 1 according to the present invention, the fuel intake mode is carried out, when the engine is stopped, during a period in which the engine speed NE is decreased to the predetermined value $\alpha$ and below. Accordingly, the fuel sucked to the high-pressure fuel pump 5 is not delivered to the common rail 6, and a predetermined amount of fuel can be stored in the pump 5. Thus, the fuel stored in the pump 5 can be delivered to the common rail 6 in a subsequent startup of the engine. Therefore, a lack of delivery of fuel at an early stage of the startup can be prevented. As a result, the pressure of fuel necessary to start the engine can be obtained in a short time, and the time for startup can be decreased.

When the fuel intake mode is carried out, the pump control valve 9 is closed until the engine speed NE is decreased to the predetermined value $\alpha$. Accordingly, the high-pressure fuel pump 5 does not suck fuel, and the delivery of fuel to the common rail 6 is gradually decreased. Therefore, the pressure of fuel can be prevented from becoming too high when the engine is stopped.

When a predetermined time has lapsed after the IG switch is turned off, the voltage of the power source of the ECU 8 is turned off to stop the fuel intake mode, so that the pump control valve 9 can be prevented from being energized by an excessive amount of current.

The present invention has been described in detail based on specific embodiments. However, several changes and modifications can be made without departing from the spirit or scope of the present invention by those skilled in the art.

What is claimed is:

1. An accumulator fuel injection apparatus, comprising:

a high-pressure fuel pump driven by an internal combustion engine;

a common rail for storing high-pressure fuel delivered from the high-pressure fuel pump;

an electromagnetic valve to open/close an intake passage which extends from a fuel supply origin to an inlet side of said high-pressure fuel pump and through which the high-pressure fuel pump sucks fuel; and control means in which a fuel intake mode to cause the high-pressure pump to suck the fuel is set and carried out during the time between receipt of operation stopping instructions by the internal combustion engine and an actual stopping of the operation (engine speed =0).

2. An accumulator fuel injection apparatus according to claim 1, wherein the control means once closes the electromagnetic valve in synchronization with an operation stopping signal to instruct the stopping of the operation of the internal combustion engine and, then, opens the electromagnetic valve to a predetermined opening angle to carry out the fuel intake mode when the engine speed is decreased to a predetermined number.

3. An accumulator fuel injection apparatus according to claim 2, wherein the control means closes the electromagnetic valve to stop the fuel intake mode after the lapse of a predetermined time after receipt of the operation stopping signal of the internal combustion engine.

4. An accumulator fuel injection method, comprising:

driving a high-pressure fuel pump by an internal combustion engine;

storing high-pressure fuel delivered by the high-pressure fuel pump in a common rail;

opening/closing an intake passage, which extends from a fuel supply origin to an inlet side of said high-pressure fuel pump and through which the high-pressure fuel pump sucks fuel, by an electromagnetic valve; and setting a fuel intake mode to cause the high-pressure pump to suck the fuel during the time between receipt of operation stopping instructions by the engine and an actual stopping of the operation (engine speed =0), and then carrying out the fuel intake mode.

5. An accumulator fuel injection method according to claim 4, comprising the step of once closing the electromagnetic valve in synchronization with an operation stopping signal to instruct the stopping of the operation of the engine, and opening the electromagnetic valve to a predetermined opening angle to thereby carry out the fuel intake mode when the engine speed is decreased to a predetermined number.

6. An accumulator fuel injection method according to claim 4, wherein the electromagnetic valve is closed to complete the fuel intake mode when a predetermined time lapses after the operation stopping signal for the engine is input.

* * * * *